US005263811A

United States Patent [19]

Teffer

[11] Patent Number: 5,263,811

[45] Date of Patent: Nov. 23, 1993

[54] VEHICLE ATTACHMENT FOR BREAKING LOOSE, LIFTING AND LOADING UNWANTED PAVEMENT

[76] Inventor: Donald F. Teffer, 5225 S. Frances Ave., New Berlin, Wis. 53151

[21] Appl. No.: 806,675

[22] Filed: Dec. 13, 1991

[51] Int. Cl.[5] ..... B66C 23/00

[52] U.S. Cl. ..... 414/729; 294/67.22; 294/92; 414/619; 414/622; 414/664

[58] Field of Search ..... 414/619, 622, 664, 668, 414/672, 684.3, 729, 663, 664, 685; 294/67.22, 67.2, 92

[56] References Cited

U.S. PATENT DOCUMENTS

| | | | |
|---|---|---|---|
| 2,772,800 | 12/1956 | Brady | 414/662 |
| 2,981,426 | 4/1961 | Casey | 294/92 X |
| 4,286,917 | 9/1981 | Mehesan, Jr. | 414/729 X |
| 4,515,522 | 5/1985 | Sonerud | 294/67.22 X |
| 4,787,810 | 11/1988 | Cawley et al. | 294/67.22 X |
| 4,921,075 | 5/1990 | Schumacher et al. | 414/663 X |

*Primary Examiner*—Michael S. Huppert
*Assistant Examiner*—Donald W. Underwood

[57] ABSTRACT

An attachment for removing pavement that can be removably mounted on the lift arms of a vehicle such as a tractor loader that includes a main frame having front and rear sides. An elongated penetrating member is mounted to extend cantilever from the front side of the main frame and an angular adjusting means is provided for orientating the penetrating member to any desired angular position from below to above horizontal. A holding member in the form of a pair of stub beams is mounted to also extend from the front side of the main frame in vertically spaced relation above the penetrating member to define a pavement receiving space therebetween into which the pavement can slide during removal. A hitch means is provided on the main frame for mounting the attachment on the lift arms of a tractor loader.

6 Claims, 3 Drawing Sheets

VEHICLE ATTACHMENT FOR BREAKING LOOSE, LIFTING AND LOADING UNWANTED PAVEMENT

FIELD OF THE INVENTION

The present invention relates to an attachment for removing slab pavement and more particularly to a single attachment that can be removably mounted on the lift arms of a tractor loader to break loose, hold, lift and dump discharge slab pavement.

BACKGROUND OF THE INVENTION

The removal of pavement such as concrete sidewalks and driveways has always been a difficult, time-consuming and expensive task. It is not uncommon for the cost of pavement removal to equal or exceed the cost of laying the new replacement pavement. If the pavement is accessible to large equipment, drop hammers or wrecking balls are employed to break up the pavement and large front end loaders are used to lift, hold and dump load the pavement into a truck for disposal. One serious disadvantage is that such large equipment cannot operate in small confined areas and frequently is too heavy to be supported by the grade on which the pavement lies. If the pavement is not accessible to such large, heavy equipment, as for example sidewalks and driveways closely adjacent buildings, or the grade will not support such large equipment, the use of light, hand-held concrete air hammers is usually required to break up the pavement. The broken pavement is then removed by hand or a very small compact size tractor loader, such as a skid steer loader, some of which have an overall width as narrow as 49", is used to remove the broken pavement.

The use of large. heavy construction machinery, such as full-size tractor loaders, to remove pavement has another serious disadvantage. This type of equipment is very heavy and it usually radically disturbs the subgrade on which the pavement lies by creating deep wheel ruts and by the bucket digging into the subgrade and removing substantial amounts of the subgrade with the pavement. Where pavement has been removed with a heavy, full-size tractor loader, extensive subgrade restoration must be made which requires that fill material, such as gravel, be added to replace the subgrade that has been removed. The fill must be graded and then compacted to meet density specifications to minimize subsequent settling of the grade. Fill is costly and grading and compacting is labor intensive and, thus, even more costly. To minimize such costs, it is common to go to the expense of laying plywood sheets on the subgrade to support the tractor loaders and minimize the cost of subgrade restoration as it has been found that the cost of plywood is less than the cost of subgrade restoration.

Because the skid steer loaders mentioned above are so small and light, they can be driven into previously inaccessible areas with only minimal disturbance to the subgrade. Because of such advantages, contractors have made extensive attempts over the years to use the small bucket of a skid steer loader to break pavement loose from its subgrade, but such attempts have been unsuccessful and can endanger both the operator and the equipment, as will now be explained. The small skid steer loader frequently does not have the power to force the front cutting edge of its bucket beneath the pavement. Even if the cutting edge of the bucket can be forced into the subgrade and under the edge of the pavement, problems still exist. The breakout force applied by the small skid steer loader frequently is not sufficient to break loose the pavement from the subgrade. Quite often the breakout force needed exceeds the tip-up capacity of these light skid steer loaders causing the entire rear end of the loader to literally rise high off the ground creating a tip-over potential that endangers the safety of the operator and risks catastrophic damage to equipment.

Even when the pavement can be broken free of the subgrade, it frequently occurs that the slabs of pavement are relatively large and the small bucket of the skid steer loader does not have the capability of holding such large, unwieldy pavement slabs even though the loader has the power to lift such pavement slabs. In such situations, the contractor must use a concrete air hammer or other means to break the large pavement slabs into pieces small enough to be safely contained within the small bucket without falling out when lifted for dump discharge into a truck. This breaking is labor intensive and very time consuming which increases the cost of the pavement removal.

In spite of extensive research and development in the construction machinery field over many decades, there is no commercially developed single attachment for a small tractor loader that can quickly and efficiently perform the multiple functions of breaking loose, holding, lifting and dump loading pavement. Therefore, a need exists for a small, rugged and tough pavement removal attachment that is simple in design, economical to manufacture, easy to quickly attach and detach to a tractor loader and efficient in performing the multiple steps required to remove pavement without significant disturbance to the subgrade. These needs have not been met by the prior art.

SUMMARY OF THE INVENTION

The invention resides in providing a pavement removing attachment that can be removably mounted on the lift arms of a vehicle, such as a tractor loader, for angular adjustment about a transverse horizontal axis to perform the multiple pavement removal steps of breaking loose, holding, lifting and dump discharging of the removed pavement into a truck. The attachment comprises a main frame that has a vertical extent and front and rear sides. A penetrating member is mounted to extend cantilever from the front side of the main frame and an angular adjusting means is provided for orientating the penetrating member to any desired angular position from below to above horizontal. The penetrating member is adapted for penetration into the interface between the pavement and the material which supports it to break loose, hold, lift and then dump discharge the lifted slab pavement into a truck. A holding means, preferably in the form of a pair of stub beams, is mounted to also extend from the front side of the main frame in vertically spaced relation above the penetrating member to define a space therebetween into which the pavement can slide during removal with the pavement being held between the penetrating member and the stub beam. A hitch means is provided on the main frame for mounting the attachment on the lift arms of a tractor loader.

Preferably, the stub beams will be significantly shorter than the penetrating members and will include a vertical position adjustment means, in the form of stub beam receiving compartments in the main frame, that will releasably support the stub beam members in any one of the compartments to adjust the space between the stub beam and penetrating members so that the space will closely match the thickness of the pavement that is to be removed.

BRIEF DESCRIPTION OF THE DRAWINGS

Referring to the drawings.

DESCRIPTION OF THE PREFERRED EMBODIMENTS

Figure 1:
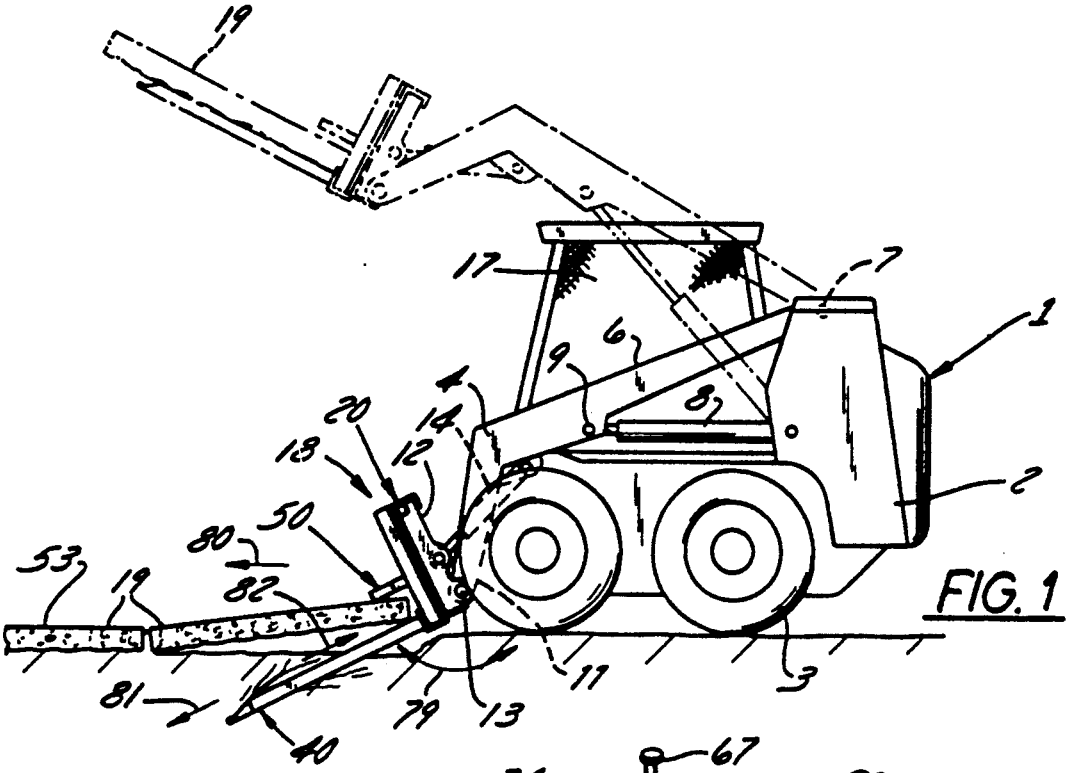
FIG. 1 is a side elevation of a tractor loader showing the pavement removing attachment mounted thereon in one position of angular adjustment for breaking loose pavement and with a dot-dash line showing the attachment in a dump discharge position.

Referring to FIG. 1, the skid steer tractor loader 1 comprises: frame 2; drive wheels 3; a lift arm assembly 4 having a rear end 6 pivotally mounted on the frame at 7; extendable and contractible lift ram means 8 pivotally connected between the frame 2 at a midpoint 9 of the lift arm assembly 4 for raising and lowering the outer free ends 11 of the lift arm assembly 4; an accessory attach frame 12 mounted on the free ends 11 of the lift arm assembly 4 for angular adjustment about a transversely extending horizontal axis 13; extendable and contractible tilt ram means 14 connected between the lift arm assembly 4 and the attaching frame 12 for angularly adjusting the latter about its axis 13; an operator's station 17; and conventional engine, hydraulic system and operating controls, not shown, for driving and steering the tractor loader, raising and lowering the lift arm assembly 4 and tilting the attach frame 12.

Figure 2:
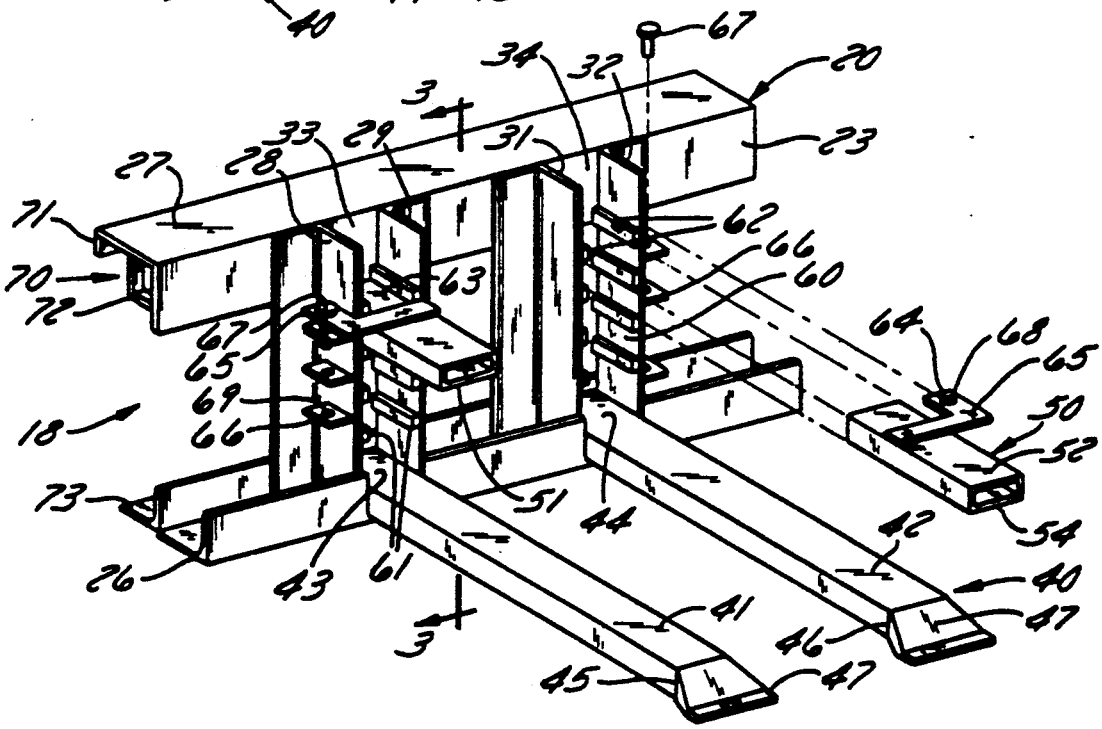
FIG. 2 is an exploded isometric projection view of the attachment shown in FIG. 1.
Figure 4:
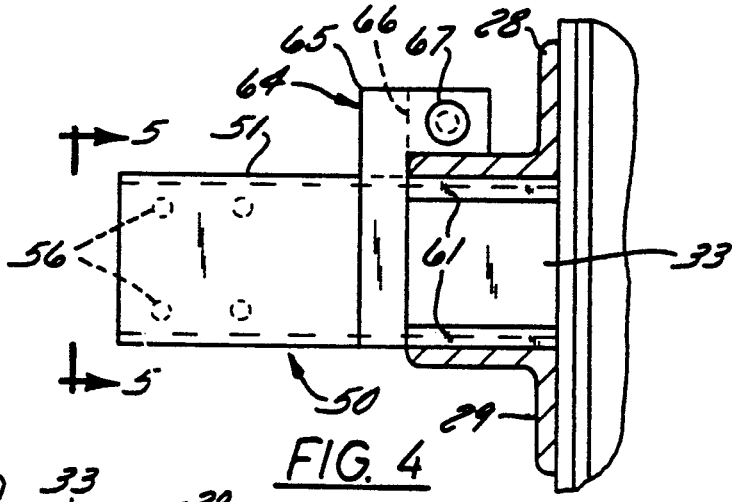
FIG. 4 is a partial sectional view taken along line 4—4 of FIG. 3.
Figure 5:
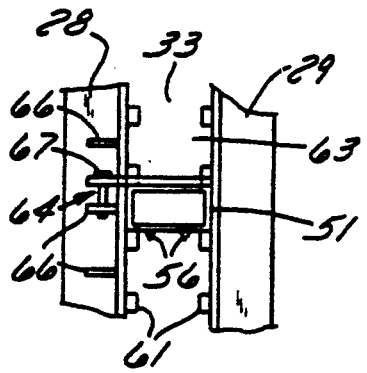
FIG. 5 is a partial front view taken along line 5—5 of FIG. 4.
Figure 3:
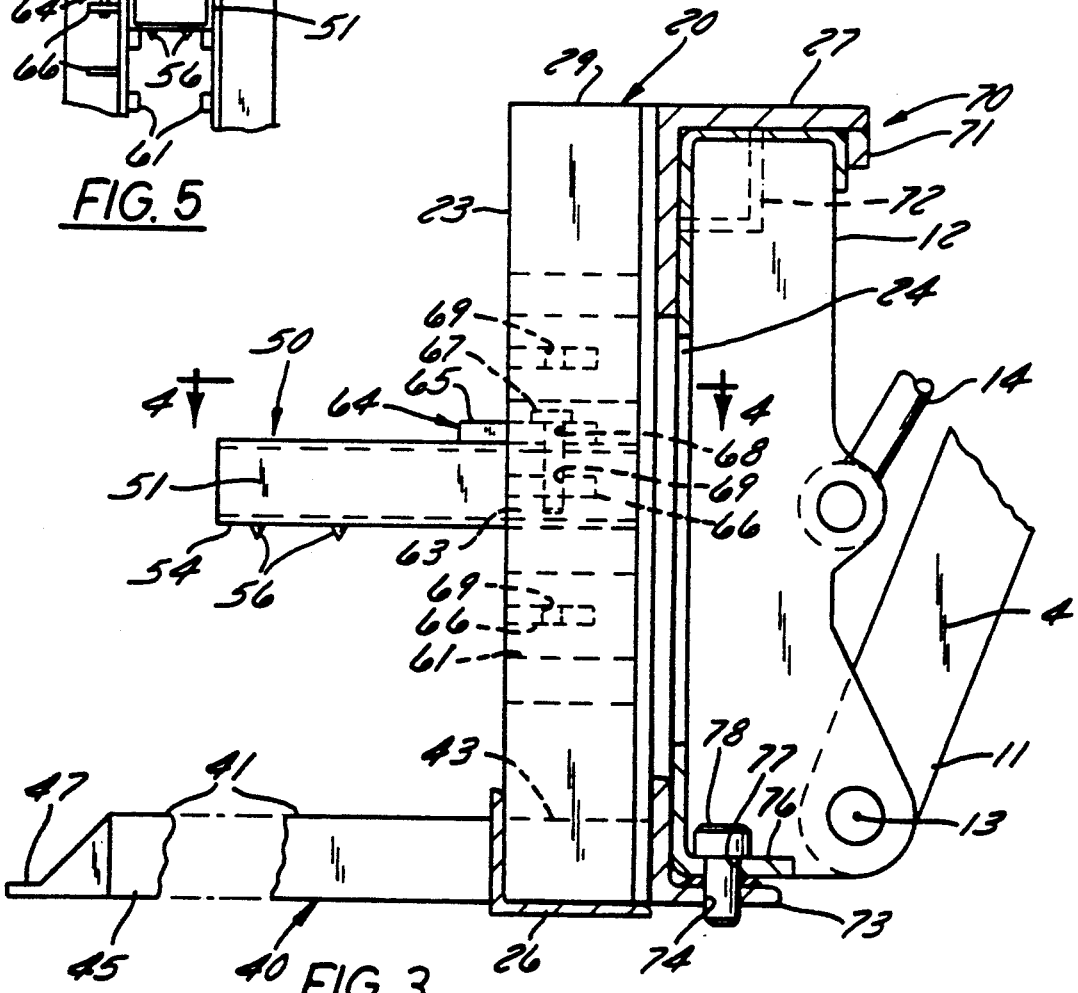
FIG. 3 is a sectional view taken along line 3—3 of FIG. 2.

The attachment 18 for breaking loose, holding, lifting and dump discharging slab pavement 19 is best shown in FIGS. 2 and 3. The attachment 18 generally comprises: a main frame 20; elongated penetrating member means 40; removed pavement holding means 50; and hitch means 70 for detachably mounting the attachment on the attach frame 12 of the tractor loader.

The main frame 20 has front and rear sides 23, 24 and includes lower and upper vertically spaced apart horizontal frame members 26, 27. First and second pairs of horizontally spaced apart vertical frame members in the form of angle irons 28, 29 and 31, 32 are rigidly secured between the upper and lower horizontal frame members 26, 27 preferably by welding to define first and second vertical channels 33, 34 on the front side 23 of the main frame 20.

The penetrating member means 40 preferably includes first and second elongated rigid earth penetrating tines 41, 42 that are horizontally spaced apart from each other. The rear ends 43, 44 of tines 41, 42 may be rigidly secured in channels 33, 34 adjacent the lower frame member 26 by welding to extend cantilever from frame member 26 for a first distance as shown in the first embodiment of FIG. 2, or they may be pivotally mounted therein to extend cantilever as is shown in the second embodiment of FIG. 6, which will be more fully explained hereinafter. The forward ends 45, 46 of the tines preferably are each equipped with a hardened wedge portion 47 to aid in forcing the tines between the bottom surface of the pavement and the support material such as earth on which it rests. While the penetrating member means 40 is shown as comprising two tines 41, 42, a greater or lesser number of tines could be used The removed pavement holding means 50 comprises at least one and preferably two stub beam members 51, 52 mounted to extend cantilever from the front side 23 of the main frame 20. The stub beam members 51, 52 are vertically spaced above the penetrating tines 41, 42 for engagement with the pavement top surface 53 during removal operations. The shape of the stub beams is optional and they should be significantly shorter than the tines 41, 42 to extend from main frame 20 for a second distance that is less than one-half of the first distance that tines 41 and 42 extend. It is necessary that the holding means 50 perform a holding function on the top surface 53 of the pavement to prevent it from slipping off of the tines during lifting and loading. If desired, the holding means could be a continuous horizontal member projecting forward from the front 23 of the main frame 20 and the undersurface 54 of the holding means could be provided with projections 56 of some type to make it more aggressive for gripping the pavement.

If the attachment 18 is only used to remove pavement of one thickness, the holding means 50 can be fixedly secured at one position vertically above tines 41, 42 to create a pavement receiving space that is slightly larger than the thickness of the pavement that is to be removed. However, pavements of different thickness are quite normal and it is preferable that the holding means 50 include a vertical position adjustment means 60 for selectively mounting the stub beams 51, 52 at any one of a plurality of predetermined vertical positions.

The vertical position adjustment means 60 comprises a vertically spaced series of first and second supports 61, 62 mounted in the first and second channels 33, 34, respectively, to define a plurality of vertically spaced stub beam receiving compartments or sockets 63. The stub beam members 51 and 52 each have a cross-sectional configuration dimensioned to be loosely received within the compartments 63 and include support surfaces coactable with the supports 61, 62 to removably hold a stub beam in its desired compartment. As shown, the holding means comprise rectangular box beams which provide great resistance to bending but it is to be understood that any cross-sectional shape, such as round or square, could be used and, of course, the compartments 63 would be configured to slidably receive whatever cross-sectional shaped stub beam is used. For example, if a rod of circular cross section were used as a stub beam, the front of channels 33 and 34 could be provided with a steel plate structure having a vertically spaced series of drilled holes therein to serve as the compartments.

The vertical position adjustment means 60 includes a latch means 64 for releasably locking each stub beam 51, 52 in its selected compartment 63. The latch means 64 includes a latch element 65 on each of the stub beams 51, 52; a latch element receiver 66 on angle irons 28 and 32; and a latch connector in the form of pin 67 that releasably passes through aligned apertures 68, 69 in the latch element 65 and latch element receiver 66, respectively.

The attachment 18 also includes a hitch means 70 for releasably mounting the attachment on the attach frame 12 of the tractor loader. The hitch means includes an upper attach frame receiving channel 71 which is part of the upper horizontal frame member 27 into which the upper edge of the attach frame 12 is slidably received. Lateral stops 72 are provided in channel 71 to locate attach frame 12 in a centered position on the main frame 20. The hitch means further includes a lower flange 73 rigidly secured to lower horizontal frame member 26 that has a center hitch pin receiving aperture 74. The lower portion 76 of attach frame 12 has a similar hitch pin receiving aperture 77 and a hitch pin 78 is passed through the aligned apertures 74, 77 to releasably secure the attach frame 12 to the rear side of the main frame 20.

To remove pavement 19, the attachment is angularly adjusted about axis 13 by tilt rams 14 to place penetrating members 41, 42 in a suitable earth penetrating angle 79 slightly below horizontal as illustrated in FIG. 1. Experience will indicate to the operator what angle works best and the angle will vary depending on the pavement thickness and soil conditions.

The lift arm assembly 4 is then slowly lowered and the tractor loader is simultaneously moved slowly forward in the direction of arrow 80 to cause the penetration members 41, 42 to slightly penetrate the earth under the pavement 19 in the direction of arrow 81. Lowering of lift arms 4 is then stopped. The members 41, 42 when so positioned constitute a gradual inclined plane and as the tractor loader is continued to be moved horizontally forward in the direction of arrow 80 without further lowering of the lift arms 4, the pavement 19 breaks loose and slides up onto the top surfaces of penetrating members 41, 42 in the direction of arrow 81. As the members 41, 42 are in a gradual inclined plane, only moderate forward force is required to cause the pavement to break loose of the subgrade, fracture at scored joints in the pavement, and slide up thereon. If there is any resistance to breaking loose, tilt and lift rams 14 and 8 can be energized singularly or together to exert pulses of additional breakout force on the pavement. Forward movement of tractor loader 1 is continued until the pavement slides into contact with the front side 23 of main frame 20 and under stub beams 51, 52 which hold the pavement in place on the attachment. The lift arm assembly 4 is then raised and the attachment tilted rearward about axis 13 to angularly adjust the penetrating members 41, 42 above horizontal and to lift the slab pavement 19 up to the dump discharge position shown in dot-dash lines in FIG. 1. The tilt rams 14 are then activated to pivot the attachment 18 about axis 13 to angularly adjust the penetrating members 41, 42 to below horizontal so that the removed pavement can slide off into a truck, not shown.

The angle of penetrating members 41, 42 needed to remove the first slabs of pavement 19 will be slightly greater than that required for removal of subsequent pavement slabs. For example, many standard city sidewalks comprise pavement having scored joints therein forming squares of about 5 feet by 5 feet. Once the first two squares of sidewalk pavement are removed, both wheels of the skid steer loader will be on the subgrade and the penetration angle of the tines 41, 42 can be reduced, provided they are still maintained in an inclined plane, to minimize disturbance of the subgrade. It has been found that if the subgrade is relatively dry, pavement squares can be successively peeled up and loaded quickly with such minimal disturbance to the subgrade that the adding and compacting of fill thereto is not required before repaving.

Figure 6:
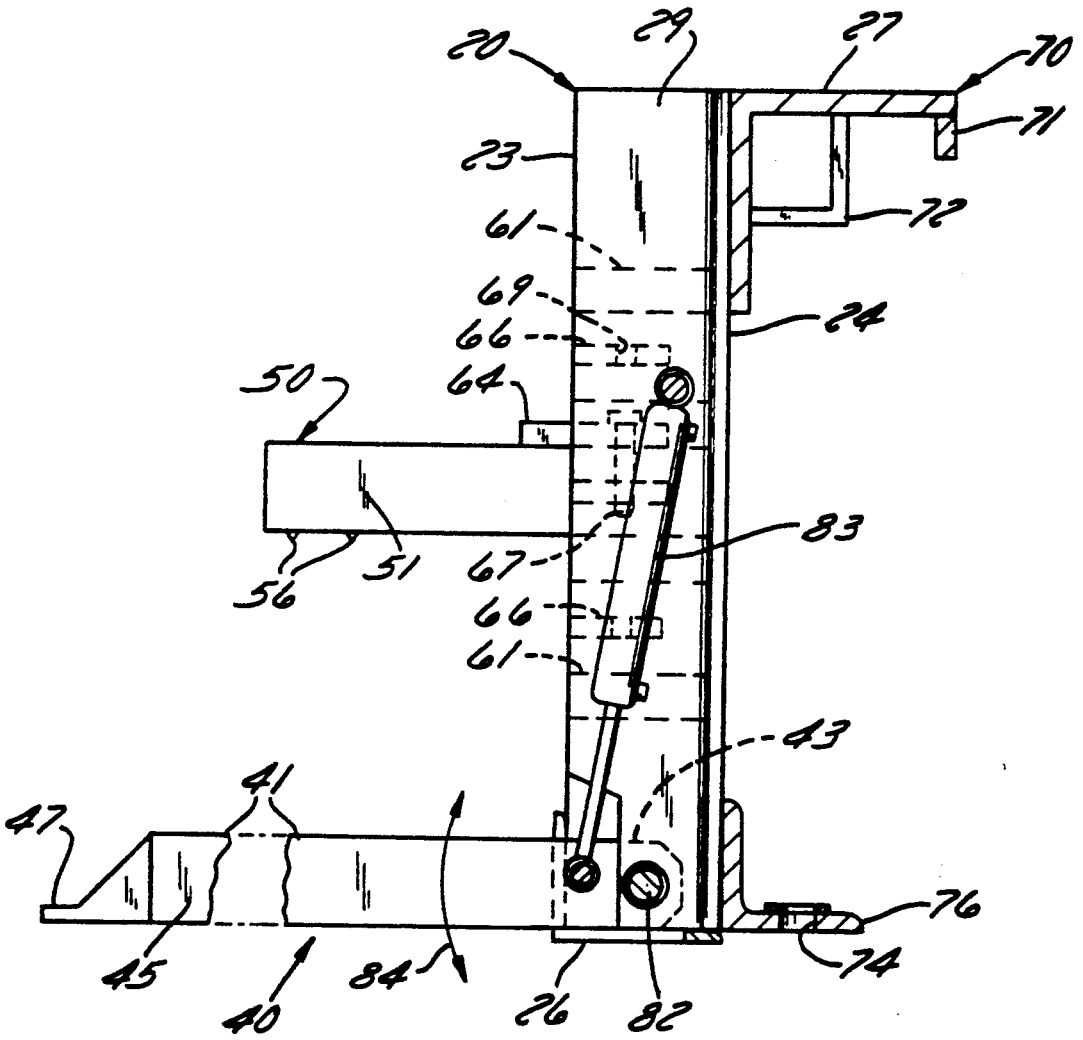
FIG. 6 is a sectional view similar to FIG. 3 showing a second embodiment of the attachment wherein the penetrating members are pivotally mounted on the main frame of the attachment.

The second embodiment of FIG. 6 is designed to be used with a tractor loader of the type that does not have an attach frame 12 tiltable about a transverse axis. In the second embodiment, the main frame 20 is fixedly mounted on the free ends 11 of lift arms 4 and the penetrating members 41, 42 are pivotally mounted on a pivot shaft 82 carried by main frame 20. An expandable and contractible double-acting angular adjust rams means 83 is operatively connected between main frame 20 and the penetrating members 41, 42 to angularly adjust them in the direction of arrow 84. The ram means 83 has hydraulic connectors 86, 87 for connection to the loader hydraulic system, not shown.

The second embodiment attachment of FIG. 6 operates in the same manner as the first embodiment with the exception that angular adjustment of the penetrating members 41, 42 is about the axis of pivot shaft 82 on the main frame. An added advantage of the second embodiment is that during lifting the ram means 83 can be contracted to angularly raise penetrating tines 41, 42 and forcibly clamp the pavement 19 between the top surface of the tines and the bottom surface of stub beams 51, 52.

What is claimed is:

1. An attachment adapted to be mounted on vertically movable lift arms of a tractor loader having a horizontal extent, for use in breaking loose, holding, lifting and dump discharging lifted slab pavement of the type that includes a top surface and bottom surface having a separable interface with a support material on which it rests comprising:

a main frame means having a vertical extent, a front side and a back side;

an elongated penetrating member means mounted directly on said front side of said main frame to extend cantilever therefrom for orientation to angular positions from below to above horizontal during use to penetrate into said interface and break loose the slab pavement, said penetrating member means having portions that are transversely set apart horizontally a distance sufficient to provide laterally spaced supports for the slab pavement carried thereon that will resist gravity foces which would tend to cause the slab pavement to slide laterally off of the penetrating member means during holding, lifting and dump discharging thereof;

a holding means mounted to extend from said front side of said main frame in vertically spaced relation above said elongated penetrating member means for engagement with said pavement top surface during pavement removal operation, said holding means including at least one stub beam member mounted to extend cantilever from said main frame and a vertical position adjustment means having a plurality of supports on said main frame vertically spaced apart from each other above said penetrating member means to define a plurality of stub beam receiving compartments at predetermined vertical positions above said penetrating member means, said stub beam member having support surfaces coactable with said supports to releasably hold said stub beam member in any selected one of said stub beam receiving compartments; and a hitch means on said main frame for mounting said attachment on said tractor loader lift arms.

2. An attachment adapted to be mounted on vertically movable lift arms of a tractor loader having a horizontal extent, for use in breaking loose, holding, lifting and dump discharging lifted slab pavement of the type that includes a top surface and a bottom surface having a separable interface with a support material on which it rests comprising:

a main frame means having a vertical extent, a front side and first and second pairs of horizontally spaced apart vertical frame members that define first and second vertical channels on said front side of said main frame means;

an elongated penetrating member means including first and second individual penetrating members mounted in said first and second channels respectively on said front side of said main frame to extend cantilever therefrom for orientation to angular positions from below to above horizontal during use to penetrate into said interface and break loose the slab pavement, said penetrating member means having portions that are transversely set apart horizontally a distance sufficient to provide laterally spaced supports for the slab pavement carried thereon that will resist gravity forces which would tend to cause the slab movement to slide laterally off of the penetrating member means during holding, lifting and dump discharging thereof;

a holding means including first and second stub beam members releasably mounted in said first and second channels respectively to extend from said front side of said main frame in vertically spaced relation above said elongated penetrating member means for engagement with said pavement top surface during pavement removal operation; and a hitch means on said main frame for mounting said attachment on said tractor loader lift arms.

3. The attachment according to claim 2 wherein said holding means further includes a vertical position adjustment means for selectively mounting said first and second stub beam members at any one of a plurality of predetermined vertical positions;

said vertical position adjustment means comprising a vertical spaced series of first and second supports mounted in said first and second vertical channels respectively to define a plurality of vertically spaced stub beam receiving compartments therein above said first and second penetrating members; and a plurality of support surfaces on said stub beam members coactable with said supports to removably support a stub beam member in any one of said stub beam receiving compartments of each of said first and second vertical channels.

4. The combination that includes:

a tractor loader having a horizontal extent, vertically elevatable lift arms and an attachment frame mounted on said lift arms for angular adjustment about a transverse horizontal axis; and an attachment mountable on said tractor loader comprising a main frame means having a vertical extent and a front side;

a hitch means on said main frame for mounting said main frame on said tractor loader attachment frame;

an elongated penetrating member means mounted directly on said front side of said main frame to extend cantilever therefrom for a first distance, said penetrating member means positionable to angular positions from below to above said horizontal extend in response to angular movement of said attachment frame about said transverse horizontal axis, said penetrating member means having portions that are transversely set apart horizontally a distance sufficient to minimize lateral tipping of any slap pavement carried thereon;

holding beam means comprising at least one stub beam member mounted to extend cantilever fashion directly from said front side of said main frame above said elongated penetrating member means for a second distance which is less than one-half said first distance; and a vertical position adjustment means for selectively mounting said at least one stub beam member at any one of a plurality of predetermined vertical positions above said penetrating member means to form a fixed vertical space therebetween having a dimension that can be selectively varied so that pavement of different thickness can be snugly received between said at least one stub beam member and penentrating members, said vertical position adjustment means including a plurality of supports on said main frame means vertically spaced apart from each other above said penetrating member means to define a plurality of stub beam member receiving compartments, and support surfaces on said at least stub beam member coactable with said supports to releasably hold said at least stub beam member in any one of said stub beam member receiving compartments.

5. The attachment according to claim 4 wherein said main frame means comprises:

lower and upper vertically spaced horizontal frame members; and first and second pairs of horizontally spaced apart vertical frame members that define first and second vertical channels on said front side of said main frame means;

said elongated penetrating member means comprises first and second individual penetrating members mounted in said first and second channels, respectively adjacent said lower horizontal frame member to extend cantilever therefrom; and said holding means comprises first and second stub beam members releasably mounted in said first and second channels, respectively, to extend cantilever fashion above said first and second penetrating members.

6. The attachment according to claim 5 wherein said holding means further includes a vertical position adjustment means for selectively mounting said first and second stub beams at any one of a plurality of predetermined vertical positions;

said vertical position adjustment means comprising a vertical spaced series of first and second supports mounted in said first and second vertical channels respectively to define a plurality of vertically spaced stub beam member receiving compartments therein above said first and second penetrating members; and a plurality of support surfaces on said stub beam members coactable with said supports to removably support a stub beam member in any one of said stub beam receiving compartments of each of said first and second vertical channels.

* * * * *